US006250012B1

(12) United States Patent
Ricci

(10) Patent No.: US 6,250,012 B1
(45) Date of Patent: Jun. 26, 2001

(54) LOUVER ASSEMBLY WITH MULTI-POSITION LOUVER ADJUSTING CONTROL ROD HAVING CLAMPING CONNECTING ARMS

(75) Inventor: Fernando Ricci, Montreal (CA)

(73) Assignee: Ricci Tools Inc., Montreal (CA)

( * ) Notice: Subject to any disclaimer, the term of this patent is extended or adjusted under 35 U.S.C. 154(b) by 0 days.

(21) Appl. No.: 08/980,436

(22) Filed: Nov. 28, 1997

(51) Int. Cl.[7] ..... E06B 7/086; E06B 7/092
(52) U.S. Cl. ..... 49/87.1; 49/74.1; 49/90.1
(58) Field of Search ..... 49/74.1, 87.1, 49/90.1; 403/97; 280/279

(56) References Cited

U.S. PATENT DOCUMENTS

| | | | | |
|---|---|---|---|---|
| 213,343 | * | 3/1879 | Morstatt | 49/87.1 |
| 272,914 | * | 2/1883 | Soule | 49/74.1 |
| 380,930 | * | 4/1888 | Poppert | 49/74.1 |
| 385,689 | * | 7/1888 | Wright | 49/74.1 |
| 395,902 | * | 1/1889 | Heidt | 49/74.1 |
| 633,013 | * | 9/1899 | Kooy | 49/74.1 |
| 2,158,074 | * | 5/1939 | Kilb | 454/313 |
| 2,207,605 | * | 7/1940 | Wolfe | 160/176.1 |
| 2,799,061 | * | 7/1957 | Hadary | 49/74.1 |
| 5,187,896 | * | 2/1993 | Ross | 49/74.1 |
| 5,303,507 | * | 4/1994 | Oille | 49/74.1 |
| 5,404,769 | * | 4/1995 | Kao | 74/551.3 |
| 5,548,925 | * | 8/1996 | Marocco | 49/74.1 |
| 5,778,598 | * | 7/1998 | Ohanesian | 49/74.1 |

* cited by examiner

*Primary Examiner*—Daniel P. Stodola
*Assistant Examiner*—Gregory J. Strimbu
(74) *Attorney, Agent, or Firm*—Swabey Ogilvy Renault; Guy Houle

(57) ABSTRACT

A louver assembly is comprised of two or more louvers, each of the louvers having pivot connections at opposed ends thereof, with the pivot connections pivotally securing the louvers between opposed stiles of a shutter frame for pivoting motion of the louvers in the frame. Each louver has a connector secured to a common longitudinal side edge thereof. Each connector has a cavity with a connector rod extending thereacross and extending co-extensively to the longitudinal axis of its associated louver. Each connector rod has at least one engageable rib on an outer surface thereof. A control rod is provided with two or more transverse connecting arms each having a connecting end recess. Each end recess has a plurality of indentations formed at a predetermined location in a curved clamping inner face thereof for receiving the rib of a respective connector rod captive therein by clamping pressure of the connecting arms about the connector rod to angulate the louvers at a desired angle.

10 Claims, 4 Drawing Sheets

LOUVER ASSEMBLY WITH MULTI-POSITION LOUVER ADJUSTING CONTROL ROD HAVING CLAMPING CONNECTING ARMS

TECHNICAL FIELD

The present invention relates to a louver assembly and wherein the louvers are each provided with a connector which is engaged by an end recess of a connecting arm of a control rod, having at least two spaced-apart arms, whereby to articulate the louvers about their pivot connections to orient and maintain them at a desired angle.

BACKGROUND ART

Shutter structures are known and comprised of louver assemblies having control rods which permit the louvers to pivot in synchronism to a desired position from a closed position to an open position. Examples of such louver adjustment mechanisms are disclosed in U.S. Pat. Nos. 5,187,896, 2,309,354 and 2,037,176. A disadvantage of such louver adjusting mechanisms is that although some of these may provide adjustment to position a plurality of louvers at a desired angle, their mechanisms do not provide for the louvers to remain at that angle when subjected to wind pressure. Accordingly, depending on the wind orientation, it is conceivable that in a room some shutters which are positioned over a window opening facing the wind may be oriented at different angles or shut as compared with shutters of other window openings oriented differently with respect to the wind. This will affect the ventilation of a room or the amount of light which is desired to penetrate the particular room. These adjusting mechanisms are also difficult to assemble due to their many component parts and are difficult to repair. There is therefore a need to provide a louver assembly with an adjustment mechanism which can secure and maintain louvers at a desired angular orientation and which is simple to install and repair.

SUMMARY OF INVENTION

It is a feature of the present invention to provide a louver assembly with a multi-position adjustment mechanism which substantially overcomes the above-mentioned disadvantage of the prior art and which fulfills the desired need.

Another feature of the present invention is to provide a louver assembly and wherein connectors are detachably secured in an edge of louvers and wherein a control rod is provided with connecting arms having an end recess which can clampingly engage the connectors and maintain the louvers angulated at a desired angle in a shutter frame.

Another feature of the present invention is to provide a shutter frame incorporating therein the louver assembly and adjustment mechanism of the present invention.

According to the above features, from a broad aspect, the present invention provides a louver assembly comprising two or more louvers of substantially rectangular outline and having pivot means at opposed ends thereof adapted for hingedly securing the louvers between opposed styles of a shutter frame for pivoting motion of the louvers in the frame on a longitudinal axis of the louvers. Each of the louvers has a connector secured to an inner longitudinal side edge thereof. The connector has a cavity with a connector rod extending thereacross and extending co-extensively to the longitudinal axis. The connector rod has engageable means on an outer surface thereof. A control rod is provided with two or more transverse connecting arms each having a connecting end recess. The connecting end recess has connecting means formed in a curved clamping inner face thereof for receiving the engageable means of the connector rod captive therein by clamping pressure of the connecting end recess about the connector rod whereby to angulate the louvers at a desired angle with respect to their longitudinal axis.

BRIEF DESCRIPTION OF DRAWINGS

A preferred embodiment of the present invention will now be described with reference to the example of a preferred embodiment illustrated in the accompanying drawings, in which.

DESCRIPTION OF PREFERRED EMBODIMENTS

Figure 1:
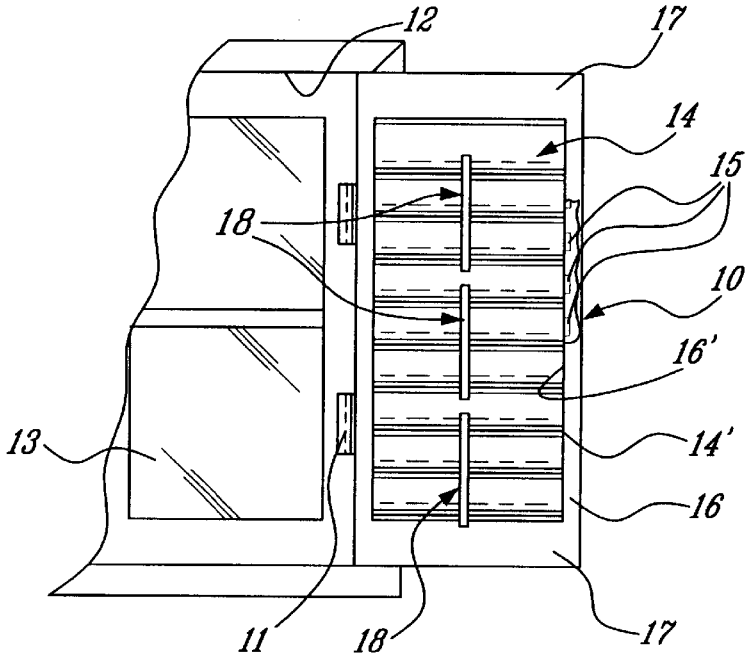
FIG. 1 is a plan view of a window frame having a shutter hingedly secured thereto and incorporating therein the louver assembly of the present invention.

Referring now to the drawings, and more particularly to FIG. 1, there is shown a shutter 10 hingedly secured by hinges 11 for displacement over the window frame opening 12 of a window pane 13. The shutter is comprised of a plurality of louvers 14 which are each hingedly connected at their opposed ends 14' by hinge pins 15 to the inner side wall 16' of the opposed parallel styles 16 which together with the end headers 17 form the frame of the shutter 10. Control rods 18 are hereinshown as attached to three associated louvers 14 to articulate the louvers to precise positions. There are three sets of louvers illustrated in this frame.

Figure 2:
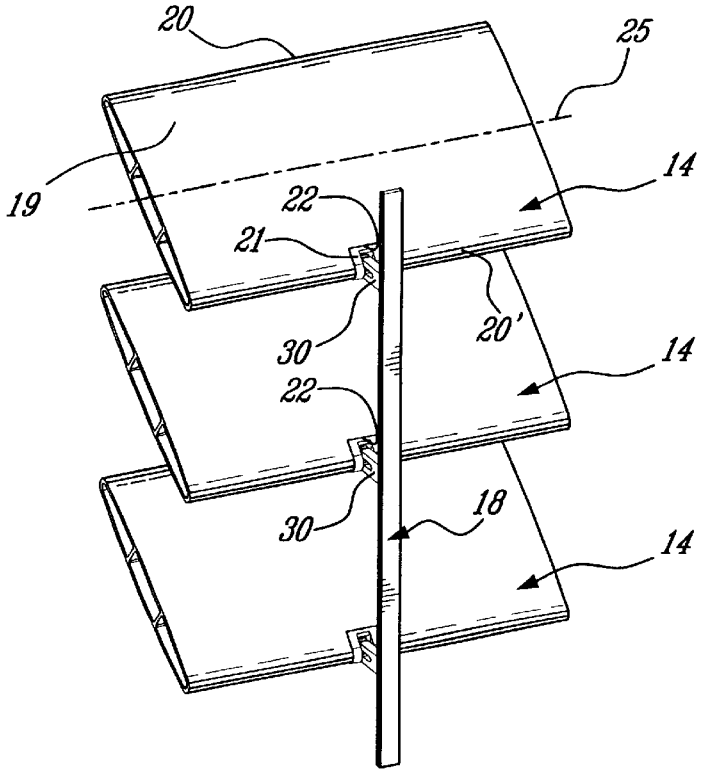
FIG. 2 is a perspective view showing the multi-position louver adjustment mechanism of the present invention.

With further reference to FIGS. 2 to 8, there will be described the construction of the louver adjustment mechanism. FIG. 2 illustrates an assembly of three louvers 14 interconnected by a control rod 18. The louvers 14 are generally constituted by elongated rectangular louver panels and as hereinshown the louvers are formed by extrusion and have arcuate side walls 19 and opposed curved side edges 20 and 20'. Side edge 20' is the inner side edge of the louvers when mounted in a shutter frame such as shown in FIG. 1. A louver connector 21 is secured in the inner longitudinal side edge 20' and substantially at mid-length of the louver. It is conceivable that the connectors may be secured at different positions and it is not essential that they be at the mid-length position. The connectors 21 are snap-fitted into a connecting cavity 22 which is formed in the inner longitudinal side edge 20' of each louver.

Figure 4A:
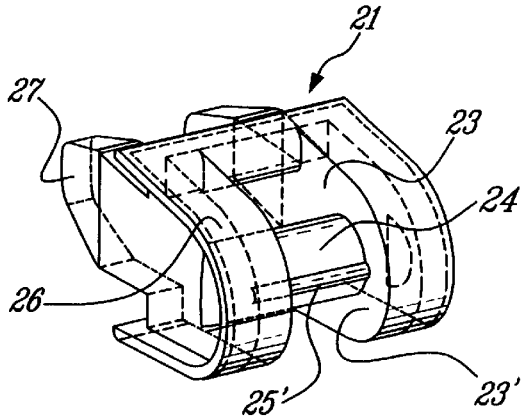
FIG. 4A is a perspective view illustrating the construction of the louver connector.
Figure 4B:
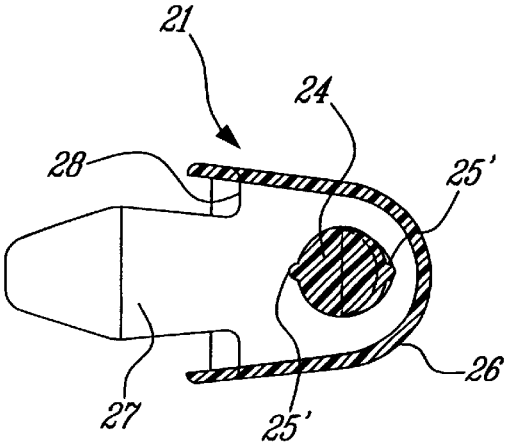
FIG. 4B is a cross-section view of the louver connector seen along section lines lines 4B—4B of FIG. 4C.
Figure 4C:
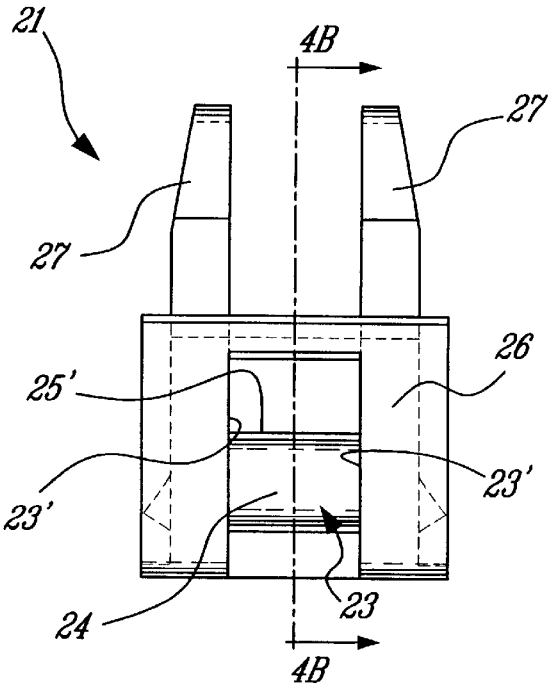
FIG. 4C is a top view of the louver connector.

Referring now to FIGS. 4A to 4C, there will be described the construction of the louver connector 21. As hereinshown, the connector has a cavity 23 of substantially rectangular shape defined between opposed side walls 23' with a connector rod 24 extending thereacross and co-extensively to the longitudinal axis 25 of its associated louver 14. The connector rod 24 is further provided with engageable means constituted by at least one arresting rib 25' and as hereinshown there are two diametrically opposed ribs 25' formed and extending longitudinally on the outer surface of the connecting rod 24. A contour outer wall 26 is also defined about the connector cavity and extends flush with the louver inner longitudinal side edge 20' and the surface of the louver side walls 19 when connected in the connecting cavity 22. A pair of connecting arms 27 extend from a rear wall 28 of the connector 21 for snap-fit interlocking with the louver 14 in the connecting cavity 22.

Figure 3:
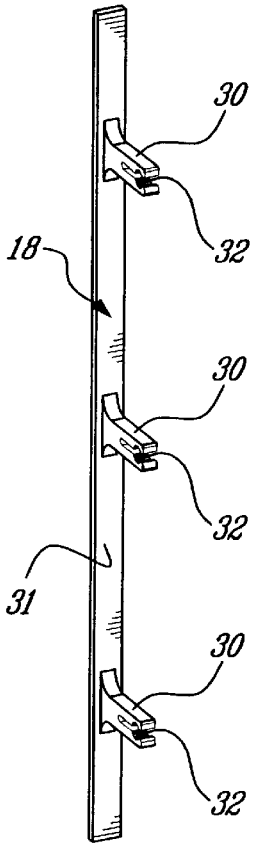
FIG. 3 is a perspective view showing the construction of the control rod provided with transverse connecting arms having connecting end recesses.
Figure 6:
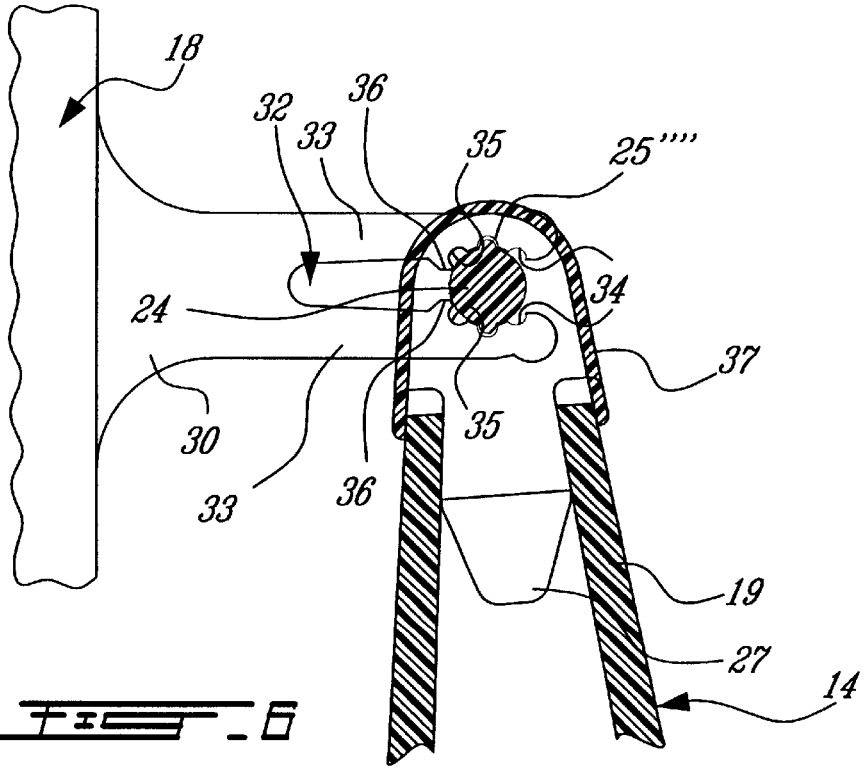
FIG. 6 is a fragmented section view showing the articulated connection between the louver connector and the connecting end recess of the connecting arms of the control rod and illustrating the construction of the connecting means herein constituted by indentations.

In order to arrest the louvers 14, as shown in FIG. 2, at a desired angular position, there is provided the control rod 18 as more clearly illustrated in FIG. 3. The control rod 18 is provided with a plurality of connecting arms 30, herein only three connecting arms 30 being shown, and with the arms 30 extending transverse to the elongated control rod 18. The connecting arms 30 extend from a common side face 31 of the control rod 18 to interlock the louvers together through the rod. Each of the connecting arms has a connecting end recess 32 which is better illustrated in FIGS. 6 and 7. As shown in FIG. 6, the connecting end recess 32 is an elongated recess formed in an end section of the connecting arm 30 and defines opposed clamping fingers 33 to each side of the connecting end recess 32. Each clamping finger has a curved clamping inner face 34 disposed opposite to one another near a free end thereof and provided with connecting means, herein constituted by a plurality of channel-like indentations 35. The clamping fingers 33 are spaced apart a predetermined distance whereby to receive therebetween a connecting rod 24 of an associated louver 14 with the arresting ribs 25' retained captive between opposed ones of the clamping fingers 33 whereby to maintain a louver 14 such as the three louvers as shown in FIG. 2, at a desired common angle with respect to their pivotal longitudinal axis 25.

Figure 5:
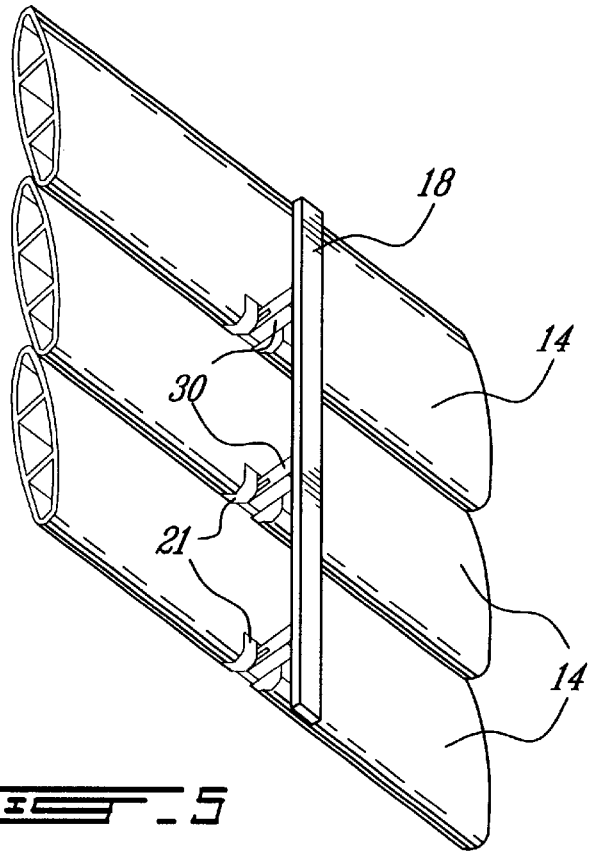
FIG. 5 is a perspective view showing the louver adjustment mechanism with the louvers disposed in a closed position with the louver connectors disposed lowermost.
Figure 8:
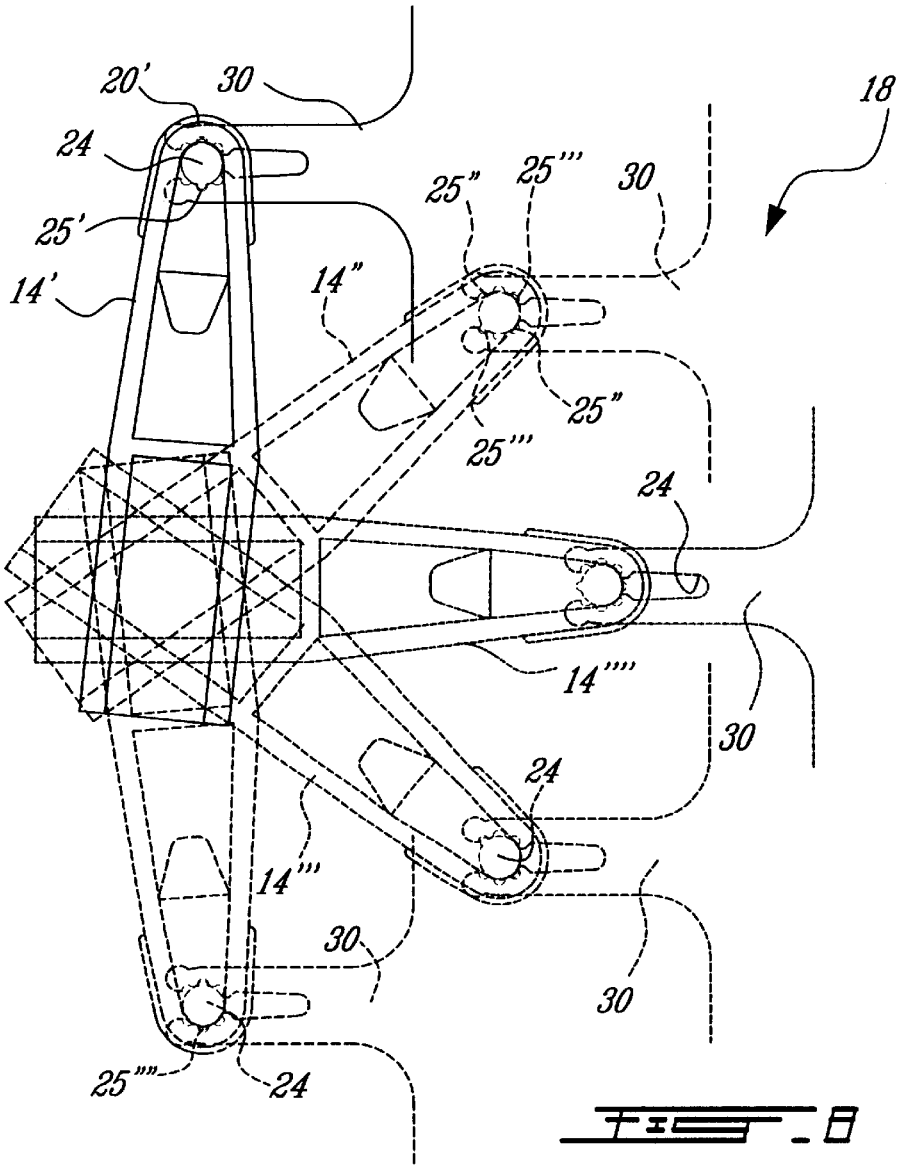
FIG. 8 is a fragmented section view showing the various positions that a louver may be arrested at with the louver adjustment mechanism of the present invention and incorporating the embodiment of the control rod having the connecting end recess illustrated in FIG. 6.

As shown in FIG. 6, the curved clamping inner faces 34 or arcuate shaped walls 34 are provided with channel-like slots 35 which constitute the indentations and there are three of these slots in each arcuate shaped wall 34 and diametrically aligned with one another. With reference now to FIG. 8, it can be seen that when the arresting ribs 25' of the connecting rod 24 are retained captive between the vertically aligned slots 25"", the louver 14' is in a closed position, similar to that as shown in FIG. 5, but with the inner longitudinal side edge 20' disposed uppermost, whereas in FIG. 5, it is disposed lowermost. The other two slots 25" and 25''' positioned to each side of the slot 25"" are oriented at an angle of 45° with respect to the vertically aligned slots 25"" whereby the louver may be positioned at an upward angle of 45° as illustrated by louver 14" and at a downward angle of 45° angle as illustrated by louver 14'''. It is also pointed out that in a shutter frame such as illustrated in FIG. 1, there may be two or more sets of louvers, herein three sets of three louvers interconnected by three control rods 18 whereby to reduce the load on the articulated clamping connections of the control rods to assure that the louvers will resist to wind pressure and maintain their desired angular position. With the louver assembly as shown in FIG. 1 it is also conceivable that only the top set of louvers may be in an open condition while the other sets remain closed or angulated differently. Accordingly, the position of each set of louvers are independently controlled.

As also shown in FIG. 6, an inner end of the arcuate-shaped walls or curved clamping inner face 34 is provided with an inner ridge 36 with the opposed ridges 36 defining a restricted mouth opening 37 therebetween and configured whereby to retain one of the arresting ribs 25' of the connecting rod 24 between the ridges 36 whereby to clampingly retain the louver in an open, substantially horizontal position as shown with louver 14"" in FIG. 8.

Figure 7:
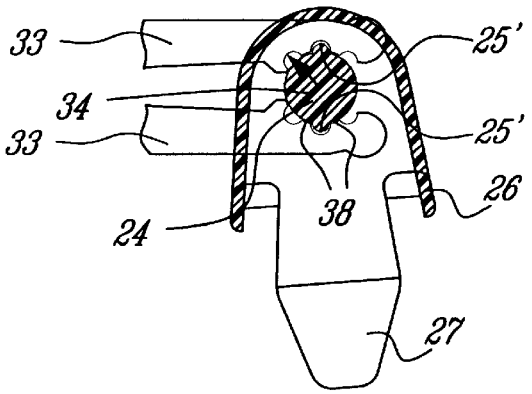
FIG. 7 is a fragmented section view similar to FIG. 6 but illustrating a further example of the connecting means herein constituted by a plurality of serrations formed in the curved clamping faces of the connecting end recess.

FIG. 7 illustrates a further example of the construction of the connecting indentations 35. As hereinshown these indentations are provided by a plurality of serrations 38 which have a complementary cross-section to the arresting ribs 25' of the connecting rod and these are disposed in a side-by-side relationship over the entire arcuate shaped wall or curved clamping inner face 34 of each of the clamping fingers 33 whereby to clampingly retain the louvers at a plurality of angles in a shutter frame.

Although FIGS. 6 and 7 show the engageable means of the connecting rod 24 as being an arresting rib, it is also conceivable that instead of a rib there could be provided a connecting slot and the curved clamping inner face 34 of each of the clamping fingers 33 of the control rods 18 be provided with diametrically opposed ribs to engage within these slots of the connecting rod 24 and thereby reversing the construction of the engageable means of the connector rod with the connecting means of the connecting end recesses of the connecting arms of the control rod.

It is also within the ambit of the present invention to cover any other obvious modifications thereof provided such modifications fall within the scope of the appended claims.

What is claimed is:

1. A louver assembly comprising at least two louvers, each one of said louvers having a substantially rectangular perimeter, each one of said louvers having pivot means at opposed ends thereof for hingedly securing said louver between opposed stiles of a shutter frame for pivoting motion of said louver in said frame on a longitudinal axis of said louver, each one of said louvers having a connector secured in a connecting cavity formed in one of opposed longitudinal side edges of said louver, each of said connectors having a cavity with a connector rod extending across said cavity of said connector, each said connector rod extending parallel to said longitudinal axis of a respective one of said louvers, each said connector rod having at least one arresting rib on an outer surface thereof, and a control rod provided with at least two transverse connecting arms to connect to a respective one of said louvers, each one of said connecting arms having a connecting end recess, each said connecting end recess defining a curved clamping face, at least two indentations formed in each said curved clamping face, each said indentation for holding said at least one arresting rib of said connector rod of said respective one of said louvers captive by clamping pressure exerted by said connecting arms to position and clampingly retain said respective one of said louvers at a desired angle with respect to said longitudinal axis of said respective one of said louvers.

2. A louver assembly as claimed in claim 1 wherein said at least one arresting rib comprises two said arresting ribs each being diametrically opposed to one another on said outer surface of a respective one of said connecting rods and extending parallel to one another.

3. A louver assembly as claimed in claim 2 wherein each said connecting end recess is an elongated recess , each said curved clamping face being formed at an outer end portion of a respective one of said connecting arms, each of said connecting arms being spaced-apart a predetermined distance to apply said clamping pressure on said connector rod of said respective one of said louvers.

4. A louver assembly as claimed in claim 1 wherein said indentations are elongated slots configured to receive said at least one arresting rib of said connector rod of said respective one of said louvers in close friction fit therein.

5. A louver assembly as claimed in claim 4 wherein said at least two indentations comprises three said indentations to clampingly retain said respective one of said louvers in one of a closed substantially vertical position and in an open position at an angle of 45° with respect to said vertical position.

6. A louver assembly as claimed in claim 4 wherein an inner end of each said curved clamping face is provided with a ridge, a restricted mouth opening is defined between said ridges of said connecting arms and configured to retain said at least one arresting rib of said connector rod of said respective one of said louvers captive therein to clampingly retain said respective one of said louvers in an open substantially horizontal position.

7. A louver assembly as claimed in claim 1 wherein said indentations comprise a plurality of serrations disposed side-by-side.

8. A louver assembly as claimed in claim 1 wherein said connector is detachably connected in a connecting cavity formed in said longitudinal side edge of one of said louvers.

9. A louver assembly as claimed in claim 8 wherein said connector has a contour outer wall defined about said connector cavity and a pair of connecting arms for snap-fit interlocking with said connecting cavity of said louver, said contour outer wall extending flush with said louver longitudinal side edge and opposed side walls thereof.

10. A louver frame in combination with a louver assembly, said louver frame comprising opposed stiles, a top header and a bottom header and defining a louver opening, said louver assembly comprising at least two sets of louvers, each set comprising at least three louvers, each one of said louvers having a substantially rectangular perimeter, each one of said louvers having pivot means at opposed ends thereof for hingedly securing said louver between said opposed stiles of said louver frame for pivoting motion of said louver in said frame on a longitudinal axis of said louver, each one of said louvers having a connector secured in a connecting cavity formed in one of opposed longitudinal side edges of said louver, each of said connectors having a cavity with a connector rod extending across said cavity of said connector, each said connector rod extending parallel to said longitudinal axis of a respective one of said louvers, each said connector rod having at least one arresting rib on an outer surface thereof, and two control rods each including a plurality of paired transverse connecting arms, each one of said connecting arms having a connecting end recess, each said connecting end recess defining a curved clamping face, at least two indentations formed in each said curved clamping face, said paired transverse connecting arms of one of said two control rods engaging said connector rods of said louvers of one of said sets of louvers, said paired transverse connecting arms of the other of said two control rods engaging said connector rods of said louvers of the other of said sets of louvers such that said louvers of said one of said sets of louvers is movable independently from said louvers of the other of said set of louvers, wherein one said indentation of each said pair of transverse connecting arms is adapted to hold said at least one arresting rib of said connector rod of a respective one of said louvers captive by clamping pressure exerted by said connecting arms to position and clampingly retain said respective one of said louvers at a desired angle with respect to said longitudinal axis of said respective one of said louvers.

* * * * *